US007603827B2

(12) United States Patent
Boyer, Jr.

(10) Patent No.: US 7,603,827 B2
(45) Date of Patent: Oct. 20, 2009

(54) APPARATUS FOR PACKAGING OF FOODSTUFFS IN CONTAINERS OF VARIOUS DIMENSIONS

(76) Inventor: Ronald S. Boyer, Jr., 213 Ridge View La., Northumberland, PA (US) 17857-1825

( * ) Notice: Subject to any disclaimer, the term of this patent is extended or adjusted under 35 U.S.C. 154(b) by 74 days.

(21) Appl. No.: 11/635,953

(22) Filed: Dec. 8, 2006

(65) Prior Publication Data

US 2008/0134637 A1 Jun. 12, 2008

(51) Int. Cl.
*B65B 5/00* (2006.01)

(52) U.S. Cl. ..... 53/250; 53/67; 53/257

(58) Field of Classification Search ..... 53/67, 53/249, 250, 257, 390; 141/369, 370, 371, 141/372, 311 R See application file for complete search history.

(56) References Cited

U.S. PATENT DOCUMENTS 3,572,549 A * 3/1971 Willsey et al. ..... 221/226
3,741,410 A * 6/1973 Henschke et al. ..... 414/795.6
3,958,720 A * 5/1976 Anderson ..... 221/93
4,121,404 A * 10/1978 Davis ..... 53/329
4,157,767 A * 6/1979 Schjeldahl ..... 221/211
4,202,387 A * 5/1980 Upton ..... 414/360
4,260,311 A * 4/1981 Hanses ..... 414/795.6
4,282,698 A * 8/1981 Zimmermann ..... 53/282
4,323,168 A * 4/1982 Callahan ..... 221/42
4,327,826 A * 5/1982 Wilson ..... 198/740
4,426,017 A * 1/1984 Ficken et al. ..... 221/222
4,446,896 A * 5/1984 Campagna ..... 141/198
4,617,778 A * 10/1986 Blackman ..... 53/391
4,678,015 A * 7/1987 Raque et al. ..... 141/131
4,880,104 A * 11/1989 Evans et al. ..... 198/445
5,010,714 A 4/1991 Medwed et al.
5,042,540 A * 8/1991 Gorlich ..... 141/174
5,105,606 A * 4/1992 Creed et al. ..... 53/499
5,329,748 A 7/1994 Belsito
5,400,838 A * 3/1995 Schjerven et al. ..... 141/174
5,684,275 A * 11/1997 Tolson ..... 177/119
5,733,184 A 3/1998 Curry et al.
6,041,835 A * 3/2000 Price ..... 141/370
6,145,552 A * 11/2000 Price et al. ..... 141/135
6,282,866 B1 9/2001 Natterer et al.
6,383,068 B1 5/2002 Tollett et al.
6,651,803 B2 11/2003 Virippil et al.
6,779,317 B2 8/2004 Wilhelm et al.
6,996,948 B2 2/2006 Koke et al.
7,077,738 B2 7/2006 Benson et al.
2005/0003059 A1 1/2005 McFarlane et al.

* cited by examiner

*Primary Examiner*—Thanh K Truong
(74) *Attorney, Agent, or Firm*—Wendy W. Koba

(57) ABSTRACT

A semi-automated packaging apparatus allows for an operator to fill a presented container without contaminating the container rim. The presentation of an empty container and subsequent removal of a filled container are performed automatically under control of the operator. The apparatus comprises a plurality of separate, removable modules including: a de-nester module for separating the containers from a stack; a container-presenting module for moving the currently de-nested container into position to be filled by an operator and subsequently removing a filled container; a removable tray with a central opening to allow an operator to place foodstuffs in the presented container; and a user interface module, coupled to each of the other modules for allowing the selection of the proper container opening dimensions (associated with the proper tray selection) and depth dimension (associated with the proper movement of the container-presenting module), as well as to control the "pace" of the packaging operation.

6 Claims, 11 Drawing Sheets

APPARATUS FOR PACKAGING OF FOODSTUFFS IN CONTAINERS OF VARIOUS DIMENSIONS

TECHNICAL FIELD

The present invention relates to an apparatus for packaging foodstuffs (such as, for example, various meats) and, more particularly, to a semi-automated apparatus that allows for an operator to fill a presented container without contaminating the container rim. The presentation of an empty container and subsequent removal of a filled container are performed automatically under control of the operator.

BACKGROUND OF THE INVENTION

There is a product line in the food industry that is generally referred to as "case-ready" product. Case-ready product can include meat and vegetables, as well as other food products, in packages comprising a container and a cover. The cover is preferably clear for viewing the product in the container. Often, the product is fresh and needs to be maintained in an environment that prevents contamination and premature spoilage. Case-ready product packages preferably include a plastic sheet cover substantially the same size as the container opening wherein the cover is sealed to an upper portion (generally, a rim) of the container.

The interiors of case-ready containers, because they are sealed, can be flushed with various gases to help preserve the freshness of the food product to extend shelf life. Shelf life is important to food processors, retailers and consumers in order to reduce costs and to provide safety for the end consumer.

In case-ready products where the cover is heat-sealed to the upper portion of the container, the use of flushing gases is particularly important to provide a seal of the required integrity. Machines have been designed to introduce a gas into the container while simultaneously heat-sealing a durable film around the rim of the container, where the containers generally comprise a polymeric (plastic) tray-type container. The machines include sealing bars that apply pressure and heat to the film, creating a heat seal to secure the cover to the container. When executed correctly, a pillow of gas is captured under the covering film. However, in cases where a good seal is not formed between the container and the cover (for example, by the presence of moisture, fat and/or protein on the sealing area of the container) the cover will not be properly secured and the product will have to be re-worked. This adds to the cost of producing products and/or elevates the risk of premature failure of the product. Re-working requires that the container be removed from the production line and placed into the machine for re-processing, and typically requires a worker to remove foreign materials from the sealing area of the container.

Currently in the meat industry, operators manually wipe the tops of the containers with towels prior to sealing. The use of operators for cleaning receptacles is expensive and sometimes results in receptacles being missed or not cleaned uniformly. In addition, when operators use towels to manually remove contaminants from the receptacles, it is up to the individual operator to determine when a towel should be disposed of and a new towel used. This can lead to sporadic quality of cleaning and can introduce the transfer of bacteria and other towel contaminants between and into receptacles.

It is also known in the food processing industry to utilize air jets to clean the tops of containers prior to sealing. This method can be successfully used with food products that tend to leave loose particulate matter or water on the sealing surface of the receptacles. However, contaminants such as proteins, fats and starches adhere more securely to the sealing surfaces. Air streams are not effective for the removal of these contaminants, to a point where sealing can be effected.

Another limitation common to most prior art meat packaging machines is that each machine is specifically developed and sized to accommodate specific package dimensions. Therefore, as container sizes change, a typical packaging machine must be taken out of service and essentially re-built to properly transport and fill the different-dimensioned package. Alternatively, a packaging facility may utilize several different pieces of apparatus, each "sized" for a different container size. As a result, the "floor space" required to perform the packaging is significantly increased, which is a concern for environments where refrigerated packaging facilities are used.

Thus, there is a need for an improved apparatus and method for packaging foodstuffs, such as meats, that overcomes the aforementioned problems.

SUMMARY OF THE INVENTION

The needs remaining in the art are addressed by the present invention, which relates to an apparatus for packaging foodstuffs (such as, for example, various meats) and, more particularly, to a semi-automated apparatus that allows for an operator to fill a presented container without contaminating the container rim. The presentation of an empty container and subsequent removal of a filled container are performed automatically under control of the operator.

In accordance with the present invention, the packaging apparatus comprises a plurality of separate, removable modules including: a de-nester module for separating the containers from a stack; a container-presenting module for moving the currently de-nested container into position to be filled by an operator and subsequently removing a filled container; a removable tray with a central opening to allow an operator to place foodstuffs in the presented container; and a user interface module, coupled to each of the other modules for allowing the operator to select the proper container opening dimensions (associated with the proper tray selection) and depth dimension (associated with the proper movement of the container-presenting module), as well as to control the "pace" of the packaging operation.

In a preferred embodiment of the present invention, the container-presenting module includes a first translator element for moving a de-nested container away from the remaining stack, an elevator element for raising/lowering the de-nested container into proper position underneath the tray opening, and a second translator element for moving the filled container away from the packaging apparatus and onto another station for sealing.

It is a feature of the present invention that an operator is used to properly position the foodstuffs in the container, an advantage for packaging certain meat cuts and other items that are best presented for sale when placed in the container in an attractive arrangement. Indeed, the operator remains in control of the "pace" of the packaging apparatus, using a simple push button to signal that a container has been filled and may be moved out by the container-presenting module, and another empty container may be presented (also under the automatic control of the container-presenting module).

In use, the machine operator enters the information regarding the dimensions of the package currently in production in the user interface module. This information is used to automatically adjust the positioning and movements of the de-nester, translators and elevator. Also, this information is checked against the dimensions of the tray currently in place at the machine. If the dimensions of the tray opening do not match the information submitted by the operator, an error message will prevent the machine from starting until the properly-dimensioned tray is in place.

By virtue of using the interface module to control the positions of the various elements within the packaging apparatus with respect to the dimensions of the container currently being used, the packaging apparatus of the present invention may be used with virtually any size or type of container, eliminating the need for a "dedicated" packaging machine for each different size of container, as was common in the prior art.

It is another advantage of the present invention that each of the modules may be individually removed for repair or replacement. The use of programmed logic control (PLC) in conjunction with the user interface provides a means for the machine operator or other technician to quickly "de-bug" any problems with the apparatus, as well as collect data regarding the packaging rate, errors in the system, and the like.

Other and further embodiments and advantages of the present invention will become apparent during the course of the following discussion, and by reference to the accompanying drawings.

BRIEF DESCRIPTION OF THE DRAWINGS

Referring now to the drawings, where like numerals represent like parts in several views.

DETAILED DESCRIPTION

Figure 1:
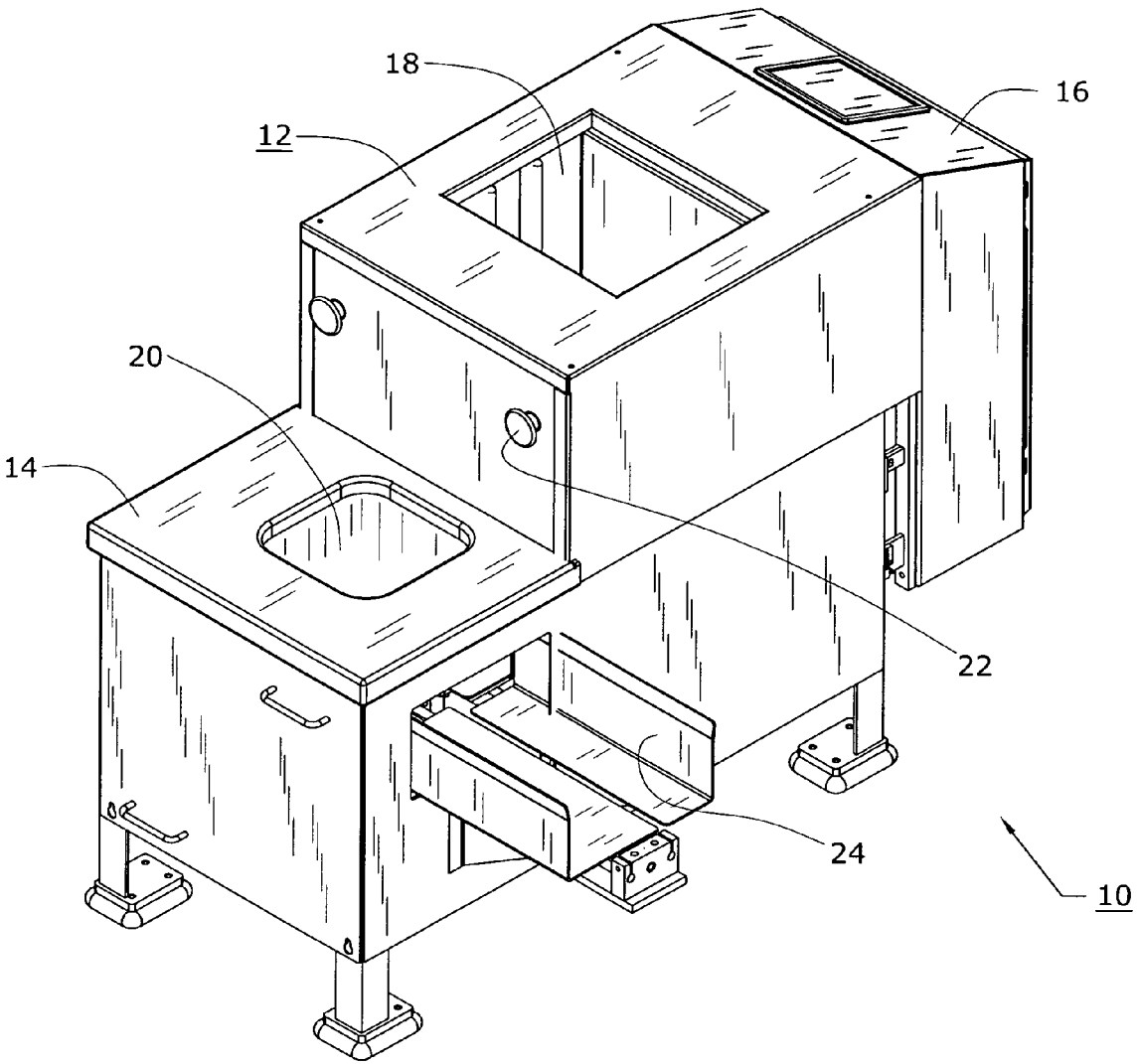
FIG. 1 illustrates, in an isometric view, an exemplary foodstuff packaging apparatus formed in accordance with the present invention.

FIG. 1 illustrates, in an isometric view, an exemplary foodstuff packaging apparatus 10 formed in accordance with the present invention. Particularly shown in this view is de-nester module 12, removable tray 14 and user interface module 16. In operation, a stack of empty containers (not shown) is loaded into opening 18 of de-nester module 12. Using an arrangement that will be described in detail hereinbelow, opening 18 is properly sized/adjusted to support the dimensions of the loaded containers, where each individual container is "de-nested" from the stack in turn. A container-presenting module (not shown in this view) then moves the de-nested container and positions the empty container underneath opening 20 of removable tray 14. An operator standing in front of removable tray 14 then proceeds to fill the empty container. Once filled, the operator presses a control button 22 to signal completion. At this point, the container-presenting module will lower the filled container, and move it along exit rail 24 toward a sealing system (not shown).

In accordance with the present invention, opening 20 of removable tray 14 is sized such that the rim of the underlying container remains protected as the operator fills the container, thus eliminating the possibility of any contaminants from adhering to the sealing rim. By virtue of utilizing a "removable" tray, other trays with different-sized openings may be used to accommodate different container dimensions, allowing for quick change-over of the packaging process. Such a change-over is not possible utilizing the dedicated packaging apparatus of the prior art.

Figure 2:
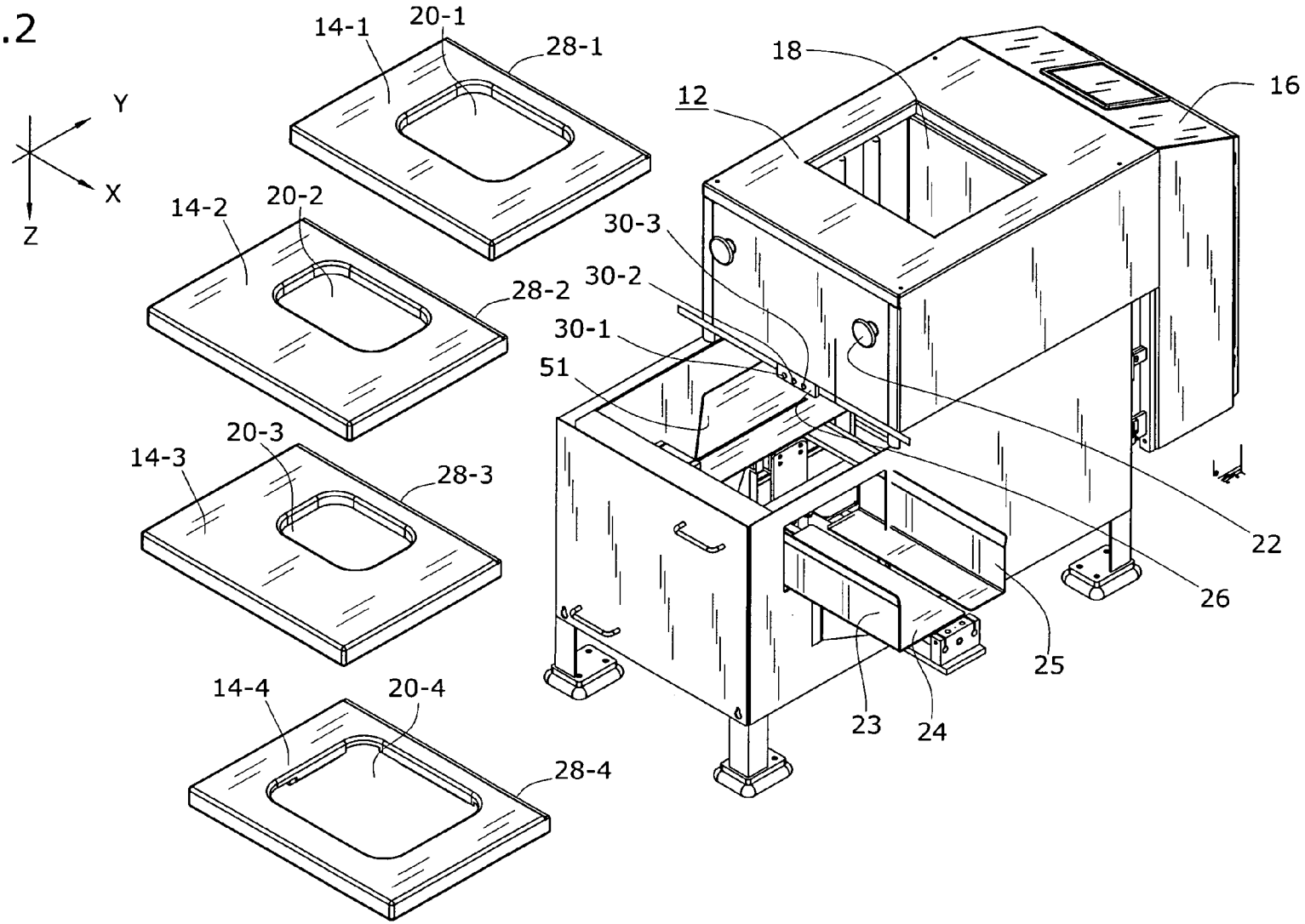
FIG. 2 is an alternative view of the packaging apparatus of FIG. 1, in this case with the tray removed from position.

In particular, FIG. 2 is an alternative view of packaging apparatus 10 of FIG. 1, in this case with tray 14 removed from the remainder of apparatus 10. Indeed, a set of four removable trays 14-1, 14-2, 14-3 and 14-4 is shown in FIG. 2, where each tray 14 has a differently-sized opening, 20-1, 20-2, 20-3, and 20-4, respectively, for accommodating a different-sized container. It is to be understood that openings 20 are associated only with the "x" and "y" dimensions of a container, and the depth of a particular container (the "z" dimension) is controlled through the operation of the container-presenting module, as will be shown hereinbelow. Another portion of the container-presenting module, a translation support member 25, is shown in FIG. 2.

Figure 3:
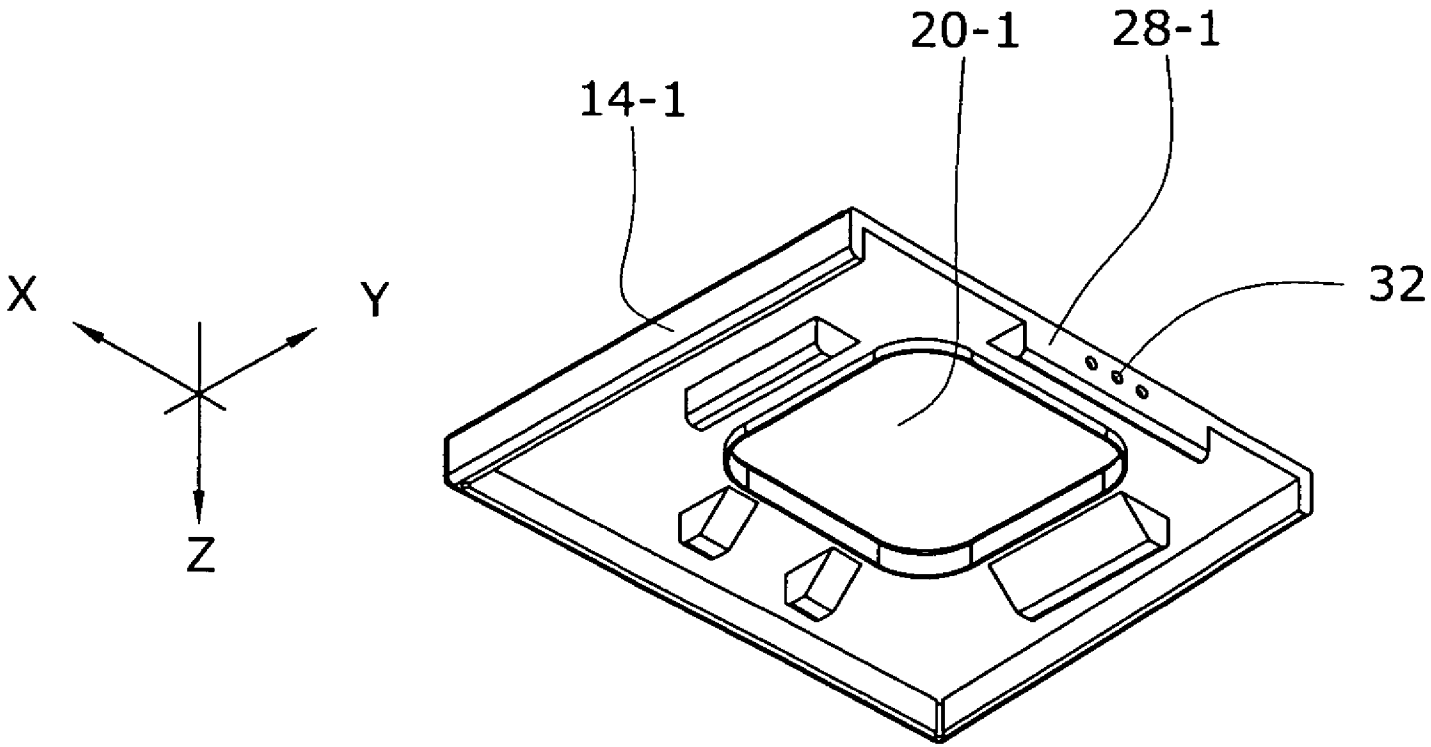
FIG. 3 illustrates an exemplary tray sensor formed in accordance with the present invention.

Also evident in the view of FIG. 2 is a tray opening sensor 26. In accordance with the present invention, sensor 26 engages with another sensor 28 located on the backside of tray 14. FIG. 3 illustrates an exemplary tray sensor 28. As shown in FIG. 2, tray opening sensor 26 comprises a set of three metal contacts 30-1, 30-2 and 30-3 (it is to be understood that fewer or more metal contacts may be required and/or used). Tray sensor 28, as shown in FIG. 3, includes a particular sensor arrangement of one or more contact elements 32 that will be disposed adjacent to sensor 26 when tray 14 is in place. The number/location of contact elements 32, when located physically adjacent to contacts 30, is used in accordance with the present invention to ascertain the size of opening 20 of in-place tray 14. For example, it is presumed in the illustration of FIG. 3 that tray sensor 28-1 on tray 14-1 includes only a single contact element 32, which will contact middle metal contact 30-2 of tray opening sensor 26 when tray 14-1 is loaded in place. The activation of only this single, middle contact is then used as an input to user interface module 16, which then matches this signal with the specific "x" and "y" dimensions of tray opening 20-1. As will be explained hereinbelow, this signal will then properly size opening 18 and properly adjust the movement of the container-presenting module. It is an aspect of the present invention that by virtue of having mechanized opening adjustments, apparatus 10 may be utilized with packages of various dimensions and, in particular, may be programmed once "on site" to the specific dimensions associated with the containers utilized by a specific packaging facility.

Figure 4:
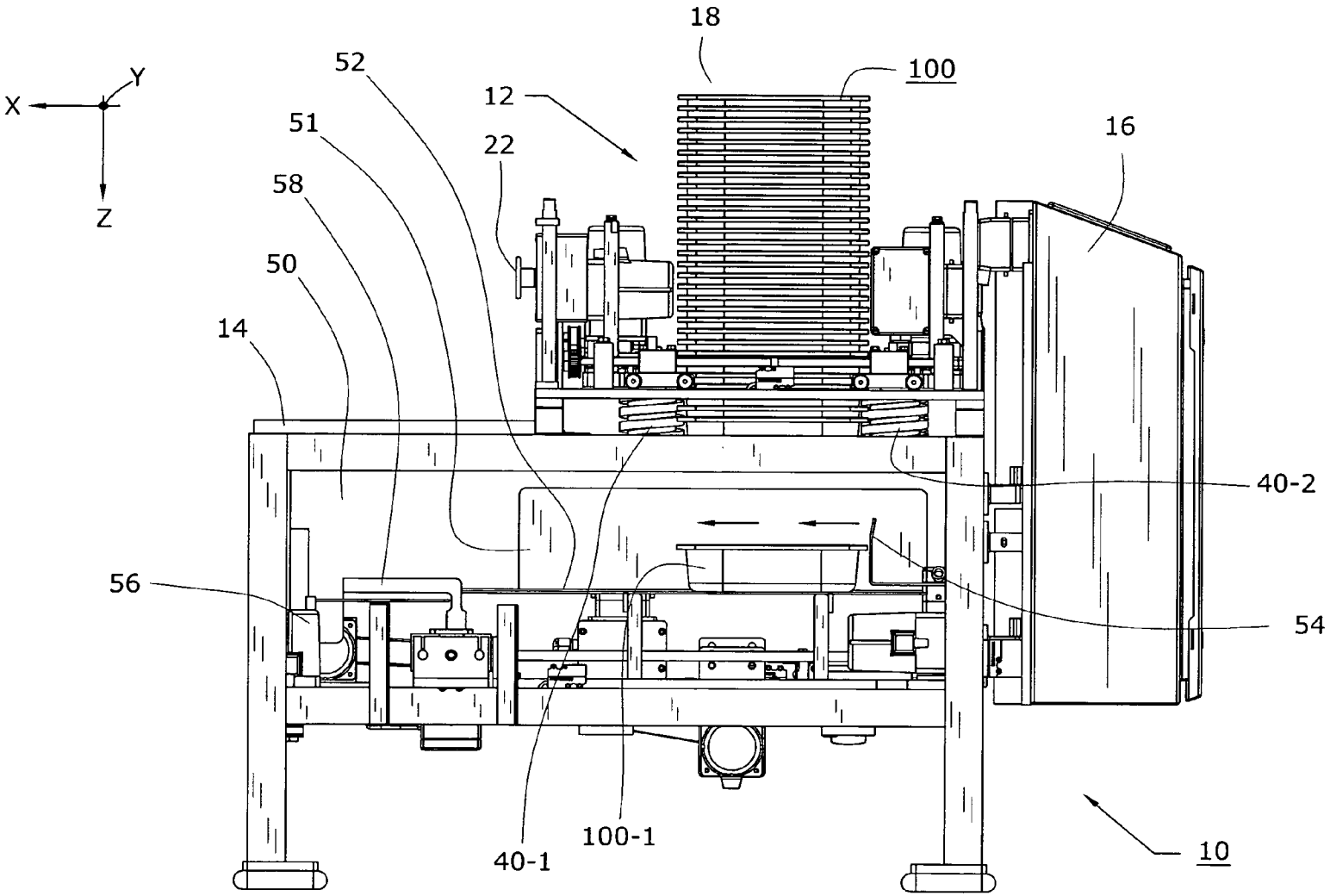
FIG. 4 is a side view of a portion of the inventive packaging apparatus, particularly illustrating in this view selected elements of an exemplary container-presenting module.

FIG. 4 is a side view of a portion of packaging apparatus 10, particularly illustrating in this view selected elements of a container-presenting module 50, as well as the placement of a stack of containers 100 within opening 18 of de-nester 12. In accordance with the present invention, a set of variable-pitch indexing screws 40-1, 40-2 are used to individually separate the bottom-most container from stack 100, and allow this container (illustrated as container 100-1 in FIG. 4) to drop into position on a conveyor element 52 of container-presenting module 50. A first containing wall 51 of conveyor element 52 is shown in FIG. 4, where a similar containing wall 53 (shown best in FIG. 5) is positioned on the opposite side. As will be discussed in detail below, containing walls 51, 53 are adjustable in accordance with the "y" dimension of container 100, so that the empty container is properly guided along conveyor element 52. Once container 100-1 drops into place between adjustable containing walls 51, 53, a first push bar of container-presenting module is activated to move container 100-1 (in the direction shown by the arrows) into position underneath tray 14. An elevation element 56 of container-presenting module 50 then raises container 100-1 into position at the underside of tray 14. In accordance with the present invention, by knowing the depth of the container (i.e., the "z" dimension of the container, information supplied by the operator), elevation element 56 will raise container 100-1 the proper distance so as to be directly underneath opening 20.

Once the operator has filled the container, he/she activates push button 22, which then lowers elevation element 56, still supporting filled container 100-1. A second push bar 58 moves filled container 100-1 out from apparatus 10 along exit rail 24 (as shown in FIG. 1).

Figure 5:
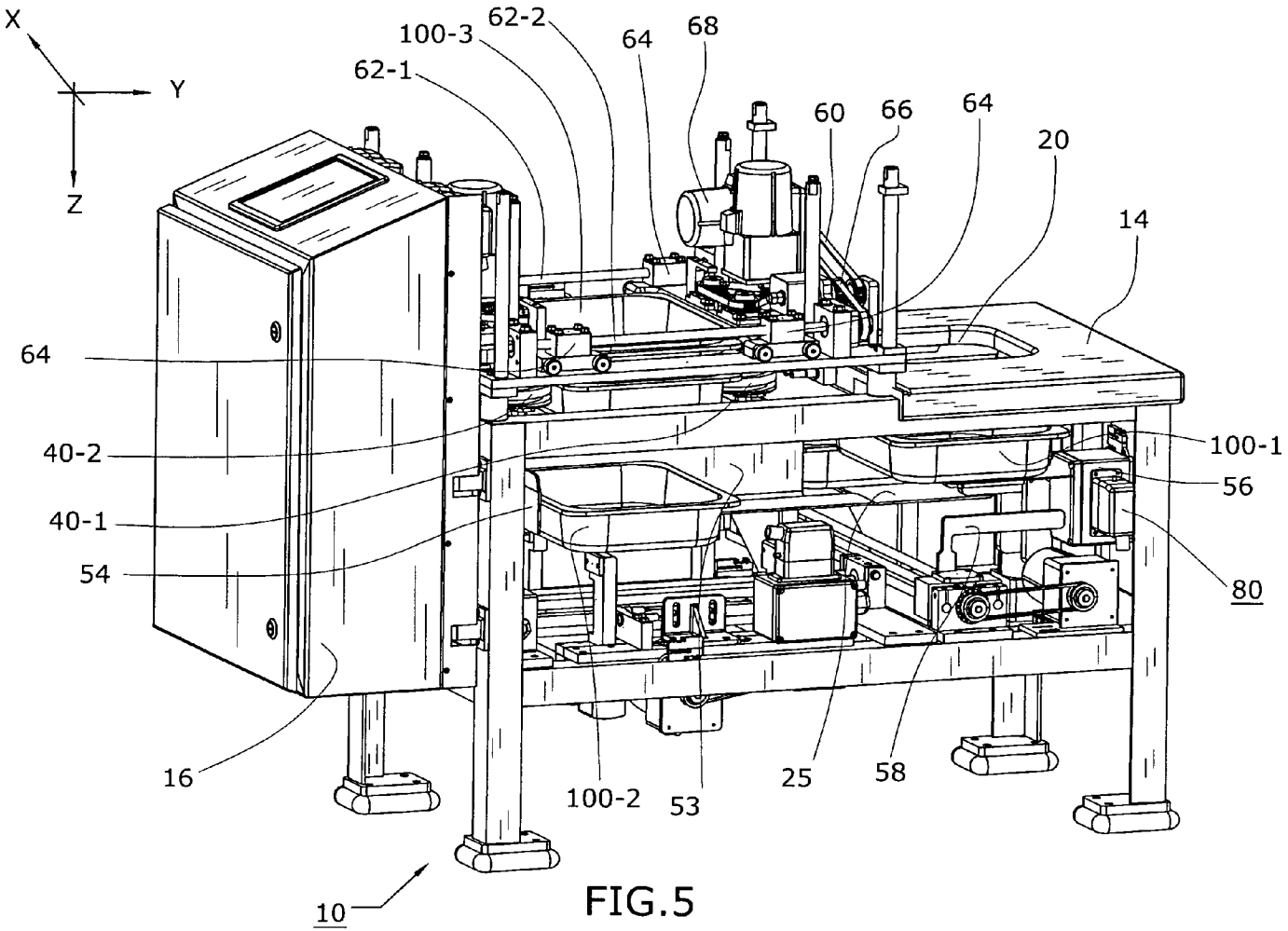
FIG. 5 is an isometric view of the packaging apparatus of the present invention, in this view showing the position of three different containers along the path from the de-nester module.

FIG. 5 is an isometric view of apparatus 10, in this view showing the position of three different containers 100 along the path from de-nester module 12, along container-presenting module 50 and then into place under opening 20 of removable tray 14. A second container 100-2 is shown in the dropped position on conveyor element 52 of container-presenting module 50, where in this view second containing wall 53 is shown. A third container 100-3 is shown within de-nester module 12 as engaged with variable-pitch indexing screws 40-1 and 40-2, so as to be the next container to be dropped once container 100-2 has been translated along conveyor element 52, where FIG. 6 contains a view of packaging apparatus 10 with (presumably filled) container 100-1 in the removal position along exit rail 24.

As mentioned above, a significant aspect of the present invention is the ability to adjust various components of the packaging apparatus as a function of the dimensions of the container currently being packaged. The ability to easily and quickly adapt the packaging apparatus itself eliminates the need to either use several machines, each dedicated to a specific container, or create "down-time" when a packaging must be turned off and manually re-arranged for use with a different-sized package.

Figure 6:
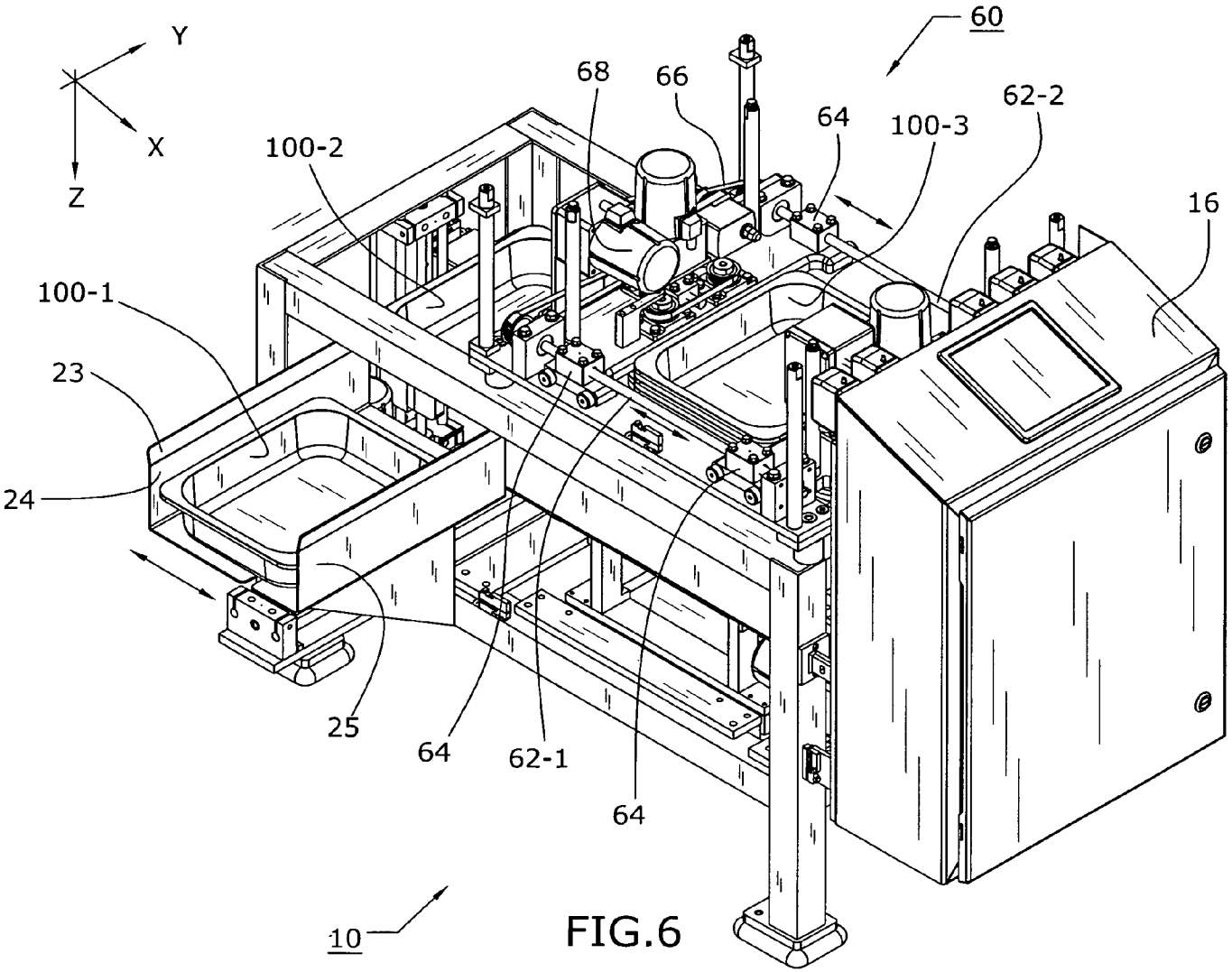
FIG. 6 contains a view of the inventive packaging apparatus, with a container in the removal position along the exit rail.

Shown in both FIGS. 5 and 6 is an x-dimension adjustment component 60 of the present invention, comprised of a number of separate elements that respond to the container dimensions input by the operator (via user interface module 16) to adjust the x-direction dimensions of various elements within apparatus 10. As mentioned above, by allowing this dimension (as well as the y- and z-dimensions) to be adjusted, packaging apparatus 10 can be utilized with virtually any of the various standard-dimensioned packaging containers (as compared to prior art packaging machines which are dedicated to a specific container size).

Figure 7:
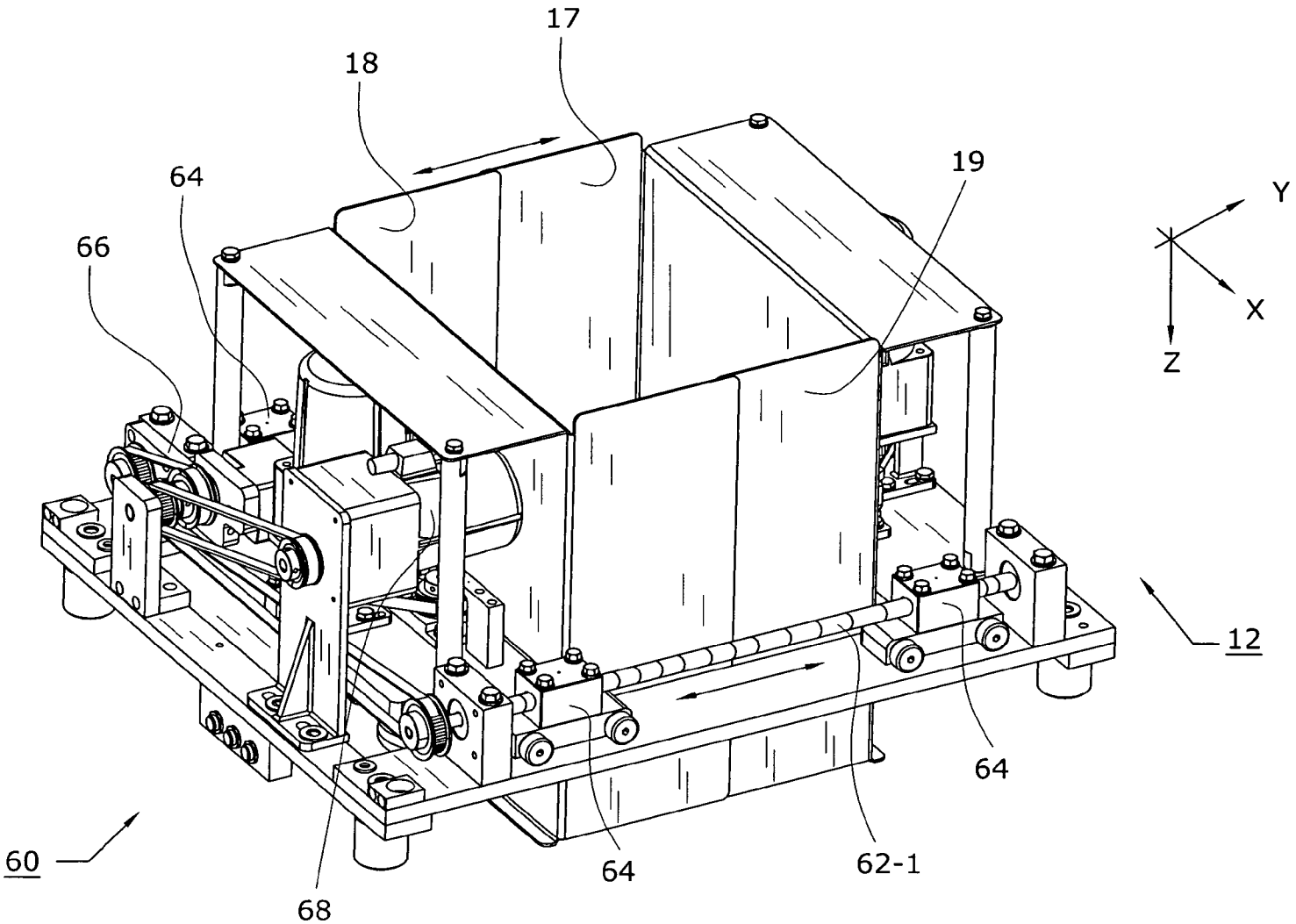
FIG. 7 illustrates in a view of a portion of the inventive packaging apparatus, an exemplary de-nester module and an exemplary x-dimension adjustment component.

FIG. 7 illustrates, in greater detail, this particular portion of apparatus 10, showing de-nester 12 and x-dimension adjustment component 60. Referring collectively to FIGS. 5, 6 and 7, x-dimension adjustment component 60 is shown as comprising a pair of threaded rods 62-1 and 62-2 and a set of internally-threaded adjusters 64, with a first pair of adjusters 64 disposed to engage rod 62-1 and a second pair of adjusters 64 disposed to engage rod 62-2. A series of drive belts 66 and associated servo-motor 68 are utilized to simultaneously rotate threaded rods 62-1 and 62-2, which will then bring adjusters 64 closer together or further apart, depending on the rotation direction of rods 62. Referring now in particular to FIG. 7, a pair of movable walls 17 and 19 are shown as being attached to adjusters 64. Therefore, as adjusters 64 move, walls 17 and 19 will move in an overlapping fashion to adjust the x-dimension spacing of opening 18. For example, a control signal from an "x dimension" processor element within user interface 16 may transmit a signal for the "x" dimension of "8 inches" to servo-motor 68, which will then activate drive belts 66 for a period of time sufficient to rotate rods 62-1 and 62-2 until adjusters 64, and associated walls 17 and 19, are eight inches apart in the x direction.

Figure 8:
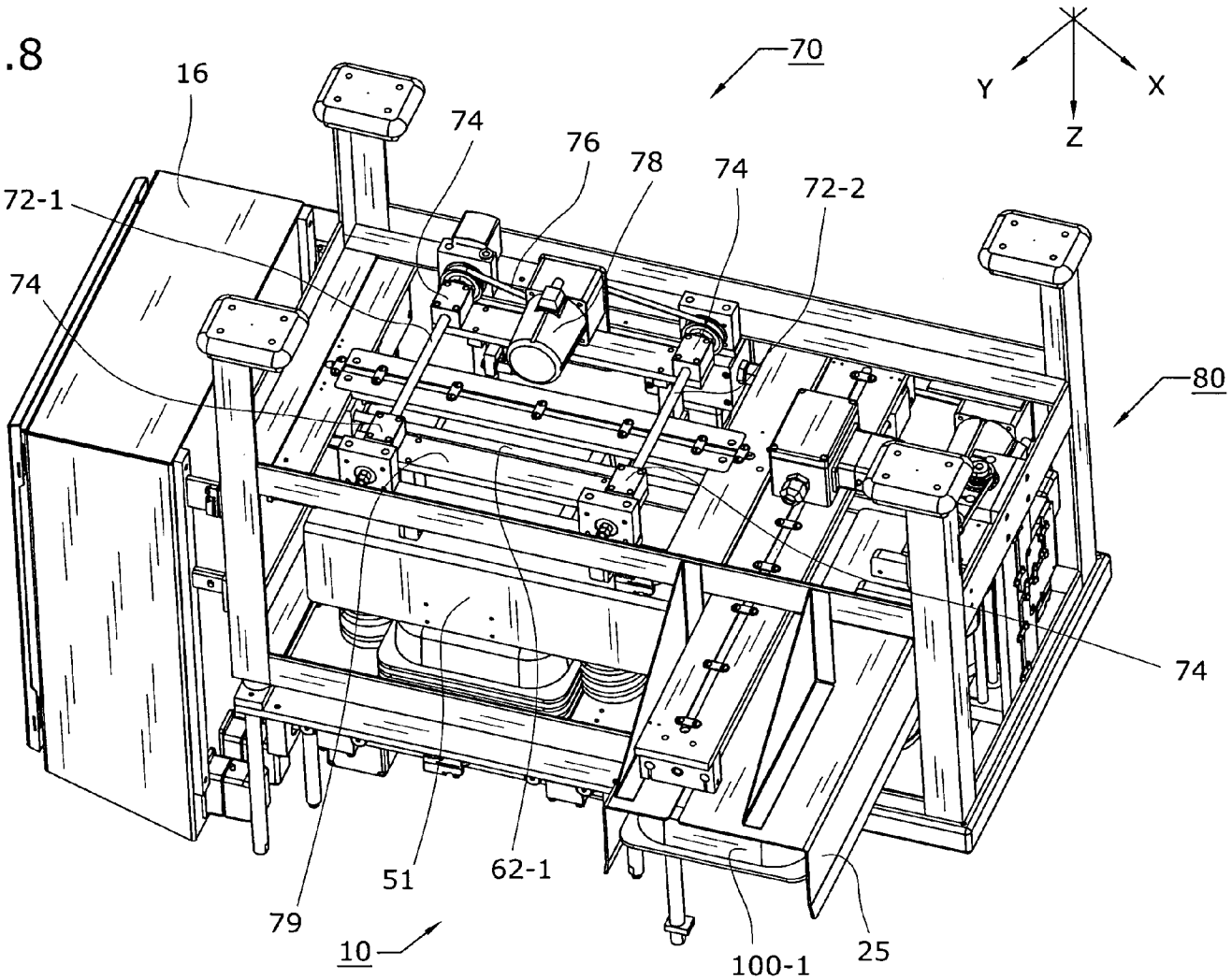
FIG. 8 illustrates an exemplary y-dimension adjustment component.

As will be discussed hereinbelow in association with FIG. 8, this same "x" dimension signal is used to adjust a pair of sidewalls 23, 25 associated with exit rail 24 and similarly control the x-direction spacing between sidewalls 23, 25 so that a container will remain properly positioned and supported as it exits packaging apparatus 10.

Container-presenting module 50 comprises, as mentioned above, a pair of containing walls 51, 53 that are used to control the y-direction spacing along conveyor element 52. A similar arrangement of threaded rods, belts and adjusters is utilized to control the spacing between walls 51 and 53, in response to a "y" dimension signal supplied by the operation. In particular, an exemplary y-dimension adjustment component 70 is illustrated in FIG. 8, which is an underside isometric view of packaging apparatus 10. As with x-dimension adjustment component 60, y-dimension adjustment component 70 comprises a pair of threaded rods 72-1 and 72-2 and an associated set of internally-threaded adjusters 74, with a first pair of adjusters 74 disposed to engage rod 72-1 and a second pair of adjusters 74 disposed to engage rod 72-2. A series of drive belts 76 and servo-motor 78 are used to control the rotation of rods 72-1 and 72-2, thus modifying the position of adjusters 74 (in response to a control signal from a "y dimension" processor element, not shown, within user interface 16) and associated containing walls 51, 53 to define the proper y-direction spacing for the containers as they are translated along conveyor element 52.

A similarly-controlled z-dimension adjustment component 80 (shown in FIG. 5) is used to control the z-direction movement of elevation element 56 so that container 100 is properly positioned underneath opening 20 of removable tray 14.

An important feature of the present invention is the modularity of apparatus 10, where each module may be separately removed, replaced, repaired, cleaned, etc., without the need to dismantle the entire system. As mentioned above, removable tray 14 simply lifts out of place to allow for quick changeover of the dimensions of opening 20 and/or to allow for tray 14 to be cleaned off. In a similar fashion, x-dimension adjustment component 60, y-dimension adjustment component 70 and z-dimension adjustment component 80 may all be individually removed for any desired repair, upgrade, cleaning, or the like.

Figure 9:
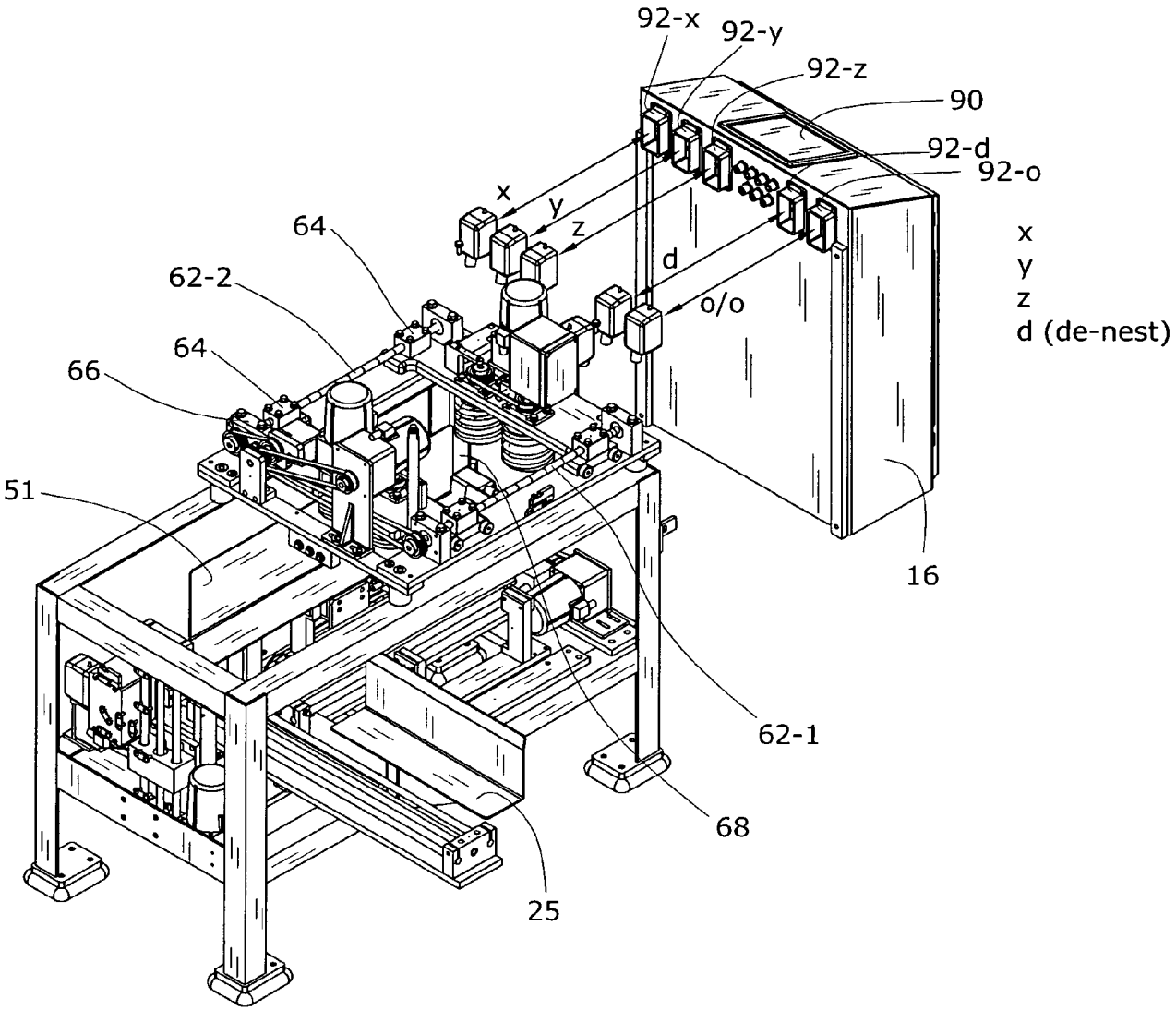
FIG. 9 illustrates, in a partial view of the inventive packaging apparatus, an exemplary user interface module, as removed from the remainder of the apparatus.
Figure 10:
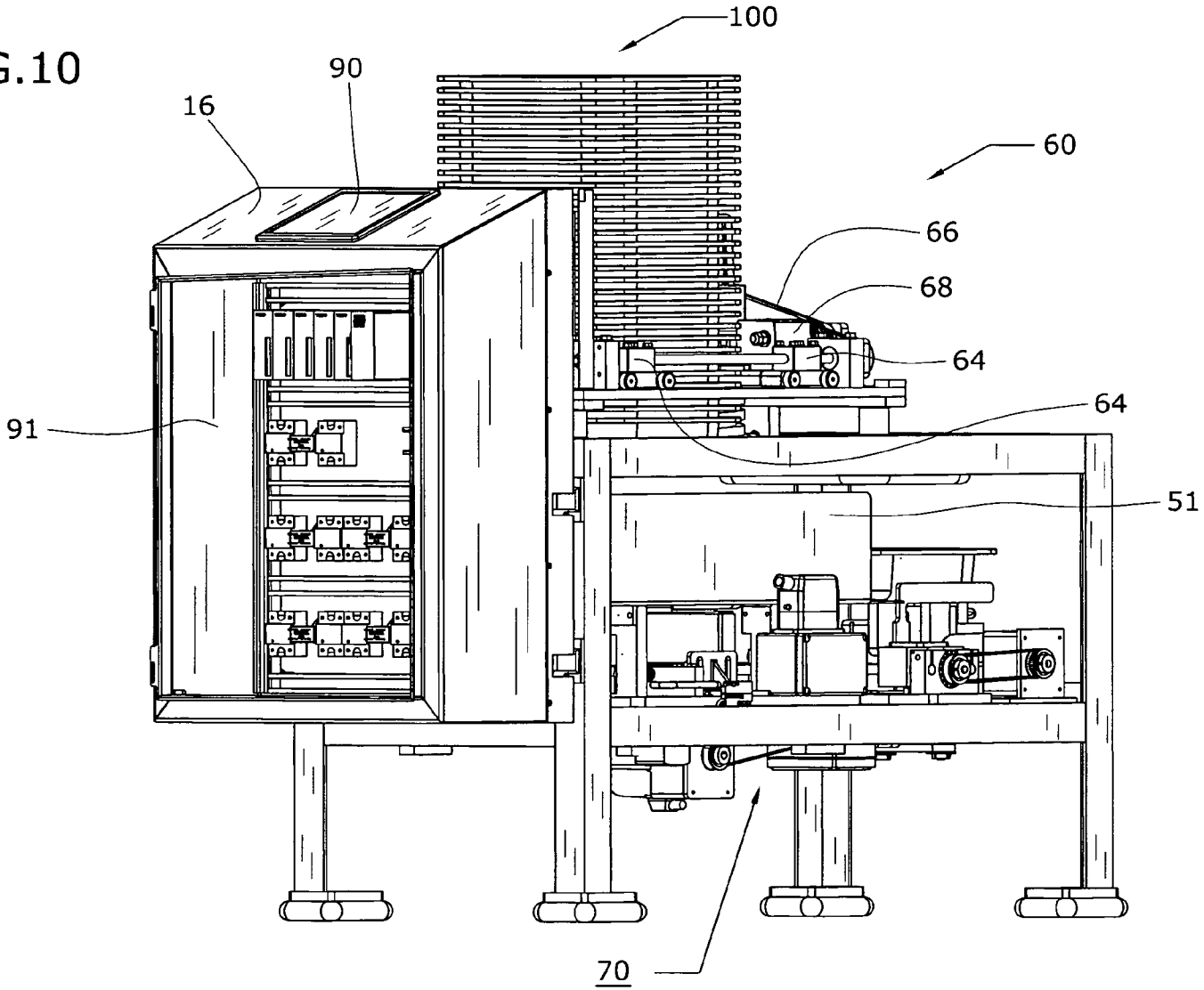
FIG. 10 is a view from the opposite direction as that of FIG. 9, illustrating some of the interior processing elements of the user interface module.

Moreover, it is significant that user interface module 16 may similarly be removed from the remainder of apparatus 10. Inasmuch as user interface module 16 contains all of the processing and control functionality for apparatus 10, it is important that this component be "portable"—for example, to be tested in an electronics testing facility, manufactured by a separate entity, and the like. FIG. 9 illustrates, in a partial view of apparatus 10, a view with user interface module 16 removed from the remainder of the apparatus. FIG. 10 is a view from the opposite direction, illustrating some of the interior processing elements of user interface module 16.

Referring back to FIG. 9, user interface module 16 is shown as comprising a data entry element 90, in this particular example a touch screen. In use, an individual responsible for the packaging process (such as, for example, a technician or maintenance personnel) will enter information via touch screen 90, perhaps in response to a series of prompts, as discussed below in association with FIG. 11. The technician's inputs are then used by a plurality of programmed logic circuits 91 (see FIG. 10) to generate the necessary signals which are then transmitted via the appropriate connections to the remainder of apparatus 10. As shown in FIG. 9, a set of five separate signal connections 92 may be used, 92-x providing the "x dimension" signal, 92-y providing the "y dimension" signal, 92-z providing the "z dimension" signal, 92-d for activating variable-pitch indexing screws 40 to initiate the de-nesting process, and 92-o for turning "on" and "off" apparatus 10. By virtue of using a removable user interface module 16, each circuit path within module 16, as well as the operation of each of the PLCs, may be individually programmed and tested prior to attaching module 16 to apparatus 10.

Figure 11:
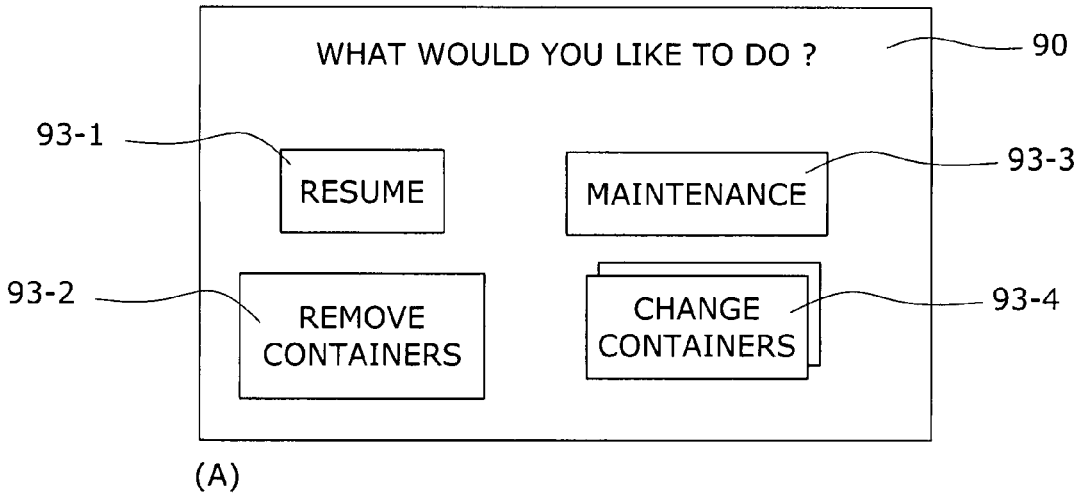
FIG. 11 illustrates a pair of exemplary touch screen displays that may sequentially presented and used to control the operation of the packaging apparatus of the present invention.
Figure 11:
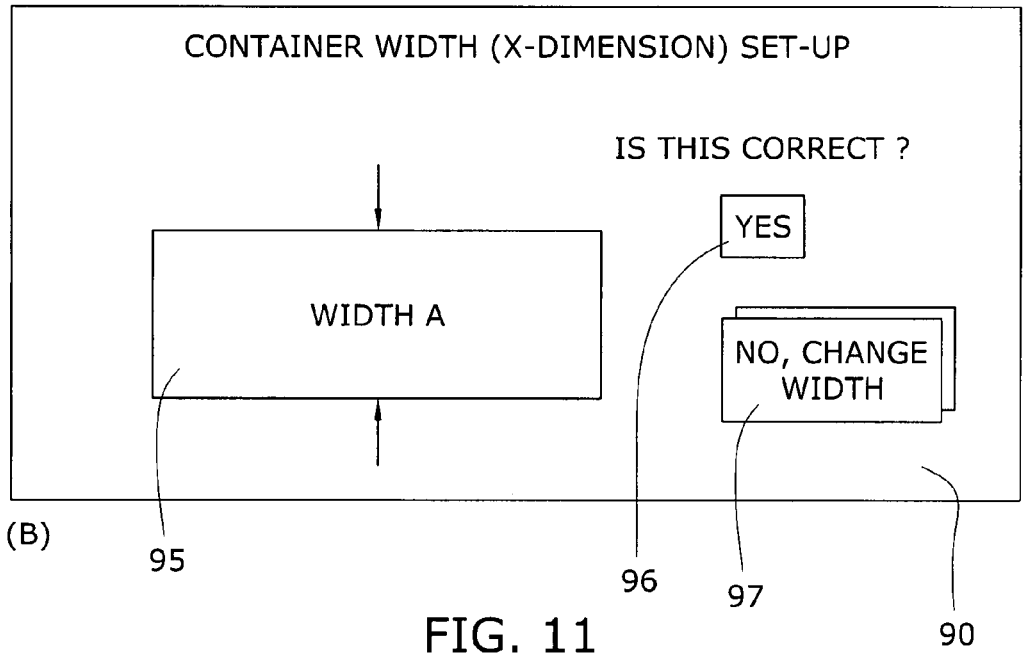

Moreover, it is to be understood that the specific interactions with apparatus 10 via user interface module 16 may be configured in any arrangement suitable for the user of the apparatus. The specifics of PLC 91 and associated processing circuits, not germane to the subject matter of the present invention, may be properly designed and configured for the particular type of interface that is desired. FIG. 11 illustrates a pair of exemplary touch screen displays that may sequentially presented and used by a technician to control the operation of apparatus 10. FIG. 11(*a*) illustrates an exemplary "main menu" display for touch screen 90, including four separate touch-sensitive initialization modes of operation. As shown, these four include "resume" mode 93-1, "remove trays" mode 93-2, "maintenance" mode 93-3, and "change tray" mode 93-4. For the purposes of discussion, it will be presumed that mode 93-4 has been selected, as shown by the highlighting in FIG. 11(*a*), in order to change the size of the container being used. By touching mode 93-4, the next screen that appears (in this example) is associated with defining the proper x-dimension for the new tray. In this embodiment, screen 90 illustrates an exemplary container width 95 (width A) and prompts the technician to respond at either touchpoint 96 for "yes"—proper width, or at touchpoint 97 for "no"—change width. Other arrangements may be used, where a particular packaging plant may have pre-defined package dimensions referred to by codes that may be used to select the correct container dimensions.

It is to be understood that many changes, modifications, variations and other users and applications of the present invention, including equivalents thereof, may become apparent to those skilled in the art after considering this specification and the accompanying drawings. All such changes, modifications, variations, equivalents and other uses and applications which do not depart from the spirit and scope of the present invention are deemed to be covered by the invention which is limited only by the claims appended hereto.

What is claimed is:

1. An apparatus for packaging foodstuffs in containers having various widths (x dimension), lengths (y dimension) and depths (z dimension), the width and length defining the opening of a container, the apparatus comprising:

a plurality of removable tray components, each removable tray component including a uniquely-sized opening slightly less than the opening of an associated container to be filed in a manner such that as a container is positioned underneath a selected removable tray component of said plurality of removable tray components, foodstuff contaminants do not contact the container;

a de-nester module including a central opening for supporting a stack of containers to be filled and removing individual containers, in succession from the bottom of the stack, the de-nester module including adjustable sidewalls for modifying the width of the central opening as a function of the width of the container currently being used;

a container-presenting module for receiving a container as it is de-nested by the de-nester module and conveying the de-nested container to a position underneath said selected removable tray component such that the container is aligned with the uniquely-sized opening of said selected removable tray component, the container-presenting module including adjustable sidewalls for providing support of the container as a function of the length of the container currently being used and an adjustable elevation element for positioning the container directly underneath said selected removable tray component as a function of the depth of the container currently being used; and a user interface module, responsive to container dimension input data for activating the width, length and depth adjustments of the apparatus to accommodate the dimensions of the container currently being used and generating a signal confirming the selection of the proper removable tray component from the plurality of removable tray components with respect to the container dimension input data.

2. The apparatus as defined in claim 1 wherein each removable tray component includes a sensor associated with the pre-defined uniquely-sized opening dimensions (width and length) of said removable tray component such that the sensor information is transmitted to the user interface module for confirmation of proper opening dimensions.

3. The apparatus as defined in claim 1 wherein each module is separately removable.

4. The apparatus as defined in claim 1 wherein the user interface module includes a touch screen element for inputting operator data associated with the dimensions of the container.

5. The apparatus as defined in claim 1 wherein the apparatus further comprises an activation button, controllable by the operator, to signal the container-presenting module to remove the container and present the next container.

6. The apparatus as defined in claim 1 wherein the container-presenting module comprises a conveying element for supporting the base of the container, in associated with the adjustable sidewalls;

a first push rod for translating a container along the conveying element from the de-nester module to the location of the selected removable tray component;

an elevator for raising and lowering a container with respect to the selected removable tray component, wherein the distance raised and lowered is controlled by the depth dimension information provided by the operator; and a second push rod for translating a container along an exit path from the apparatus.

* * * * *